US006932328B2

(12) United States Patent
Shreiner et al.

(10) Patent No.: US 6,932,328 B2
(45) Date of Patent: Aug. 23, 2005

(54) RAIL INSTALLATION AND ADAPTER THEREFOR

(75) Inventors: Thomas A. Shreiner, Picture Rocks, PA (US); Brian T. Mincemoyer, Milton, PA (US)

(73) Assignee: Construction Specialties, Inc., Lebanon, NJ (US)

( * ) Notice: Subject to any disclaimer, the term of this patent is extended or adjusted under 35 U.S.C. 154(b) by 0 days.

(21) Appl. No.: 10/438,710

(22) Filed: May 15, 2003

(65) Prior Publication Data

US 2004/0227135 A1 Nov. 18, 2004

(51) Int. Cl.[7] ..... E04H 17/24

(52) U.S. Cl. ..... 256/65.16; 256/59; 248/251; 403/348

(58) Field of Search ..... 256/59, 65.16, 256/65.01, 65.02; 248/345.1, 251; 403/394, 348, 349, 350, 381

(56) References Cited

U.S. PATENT DOCUMENTS 6,036,156 A * 3/2000 Collette et al. ..... 256/59 X
6,508,458 B1 1/2003 Bartlett et al.
6,599,055 B2 * 7/2003 Auer et al. ..... 403/381

* cited by examiner

*Primary Examiner*—John R. Cottingham
(74) *Attorney, Agent, or Firm*—Baker Botts LLP

(57) ABSTRACT

A rail and wall support installation includes an adapter which mechanically couples a wall support having a rotatable locking cam portion to an undercut groove on the rear of the rail. The adapter serves both as a mechanical attachment point for the rail to a wall support and to transfer the camming action of the locking cam portion to the rail. The adapter allows existing wall supports to be used with rails that are not directly compatible with the locking member, such as pre-existing rails.

23 Claims, 4 Drawing Sheets

RAIL INSTALLATION AND ADAPTER THEREFOR

BACKGROUND OF THE INVENTION

1. The Field of the Invention

The present invention relates to elongated rails, such as handrails, of the type that are mounted on walls, posts, or other structures by a number of spaced-apart supports and, more specifically, to an adapter for use in joining the rails to the supports.

2. The Related Art

U.S. Pat. No. 6,508,458, issued on Jan. 21, 2003 to Bartlett et al. and commonly owned herewith by Construction Specialties, Inc., discloses and claims a rail installation, including a rail and supports therefor, in which each support includes a lock member having a rotatable cam portion of a size and shape for insertion, in an unlocked rotational position thereof, into an axially-extending undercut groove on the rail, and for frictionally engaging, in a locked rotational position thereof, the walls of the undercut groove to secure the rail against displacement relative to the supports. The innovative rail installation of the '458 patent affords important advantages in the ease and economy of attachment/removal of rail assemblies to/from walls or other supporting surfaces.

In particular, as the undercut groove can accept the lock members at various locations along the length of the rail, the supports need not be installed precisely lengthwise of the rail in order to ensure registry of holes in the rail with the supports. Also, the rail need not be pre-drilled or drilled in situ to fasten it to a support. Another advantage is that covers and/or other components of the rail can be pre-assembled to the rail before the rail is attached to the supports. Still further, all of the supports may be installed on the wall or post system (or other supporting structure) before the rail is installed. Conversely, the rail can be removed from the wall supports for repair or replacement without preliminary disassembly of the rail components.

In view of the very significant benefits of the '458 patented invention, it is desirable to extend some or all of such benefits to pre-existing or other rail configurations that are not directly dimensionally or functionally compatible with the rotatable locking structure of the '458 patent.

SUMMARY OF THE INVENTION

It is an object of the present invention, therefore, to provide an adapter, and a rail installation including such an adapter, which establishes the necessary compatability between the rail and the rotatable locking structure of the supports. In accordance with the invention, the adapter is functionally integrated into the rotatable locking structure so as to mechanically couple the locking action of the rotatable locking cam portion of the lock member to the rail.

In a preferred embodiment, the adapter includes (i) an extended portion adapted to be received in an undercut groove on the rail, the extended portion being movable between an unlocked position in which it can enter the undercut groove and a locked position in which it engages walls of the undercut groove to lock the rail to the adapter, and (ii) an undercut recess facing the support, the undercut recess having a size and shape such that, when the locking cam portion is in the unlocked rotational position, it can enter the undercut recess and such that, when the locking cam portion is in the locked rotational position, it causes the extended portion of the adapter to move from the unlocked position to the locked position and thereby retain the rail against displacement relative to the support.

The adapter preferably comprises two substantially identical components that are mated together in reversed, back-to-back relation to form the complete adapter. Each component is formed as a unitary part of high-strength moldable or formable material. This simplified design and construction of the adapter minimizes the number of components required and reduces manufacturing and assembly costs.

Each adapter component includes an extended member, preferably in the form of a cantilevered arm having a flange at its free end, which together with the like extended member of the other component comprises the extended member of the adapter that is received in the undercut groove of the rail retainer. Each component also preferably includes a molded-in alignment pin and mating recess which are slidably engaged with the like pin and mating recess of the other component when the adapter halves are mated together. Rotation of the locking cam portion to the locked rotational position causes the two adapter components to be moved away from each other so as to cause the extended members of the adapter components to engage the walls of the undercut groove, the two adapter components being guided in such movement by the mating engagement of the pins and recesses of the adapter components.

A rail and support installation in accordance with the invention includes an elongated rail having an axis, an undercut groove extending axially along the rail, an adapter as described above, and a plurality of supports attached to the rail in spaced-apart relation. Each support includes (i) a bracket member having a supported surface adapted to engage the structure on which the rail is mounted and a supporting surface spaced apart from the supported surface, (ii) a lock member received on the supporting surface of the bracket member and having a locking cam portion received in the undercut recess of the adapter, the locking cam portion having a size and shape such that, when in an unlocked rotational position relative to the undercut recess, it can enter the undercut recess and such that, when in a locked rotational position relative to the undercut recess, it causes the extended portion of the adapter to move from the unlocked position to the locked position and thereby retain the rail against displacement relative to the support, and (iii) a fastener joining the lock member to the bracket member against displacement of the lock member relative to the bracket member and for rotation of the lock member relative to the bracket member. In one embodiment, the undercut groove on the rail comprises a pre-existing nut slot in the rail retainer which is dimensionally incompatible with the locking cam structure of the locking member. By use of the adapter of the present invention, the pre-existing nut slot may nevertheless serve as a point of attachment of the rail to the wall supports.

BRIEF DESCRIPTION OF THE DRAWINGS

For a better understanding of the invention, reference may be made to the following description of exemplary embodiments thereof, taken in conjunction with the accompanying drawings, in which.

DESCRIPTION OF EXEMPLARY EMBODIMENTS

By way of background, FIGS. 1–4 correspond generally to FIGS. 1–4 of the aforementioned U.S. Pat. No. 6,508,458, the entire disclosure of which is hereby incorporated by reference for all purposes.

Figure 2:
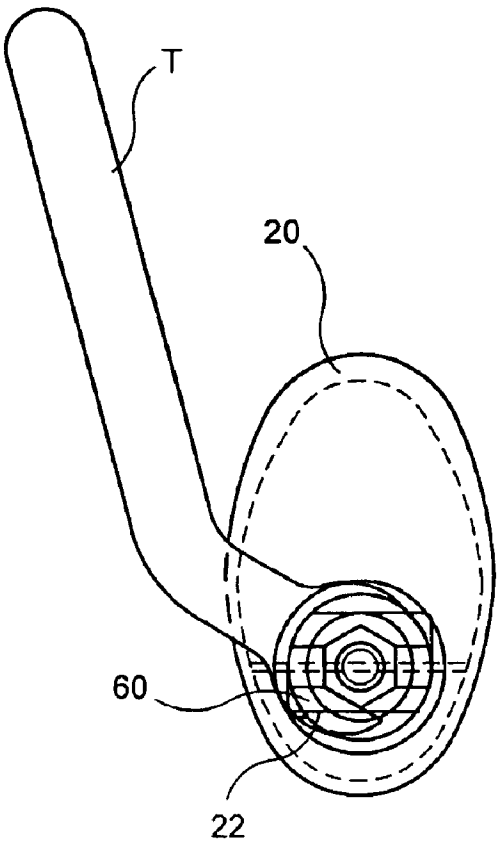
FIG. 2 PRIOR ART
FIGS. 1–4 illustrate the attachment of a rail to one of a plurality of supports in accordance with the disclosure of U.S. Pat. No. 6,508,458, of which the present invention is an improvement.
Figure 1:
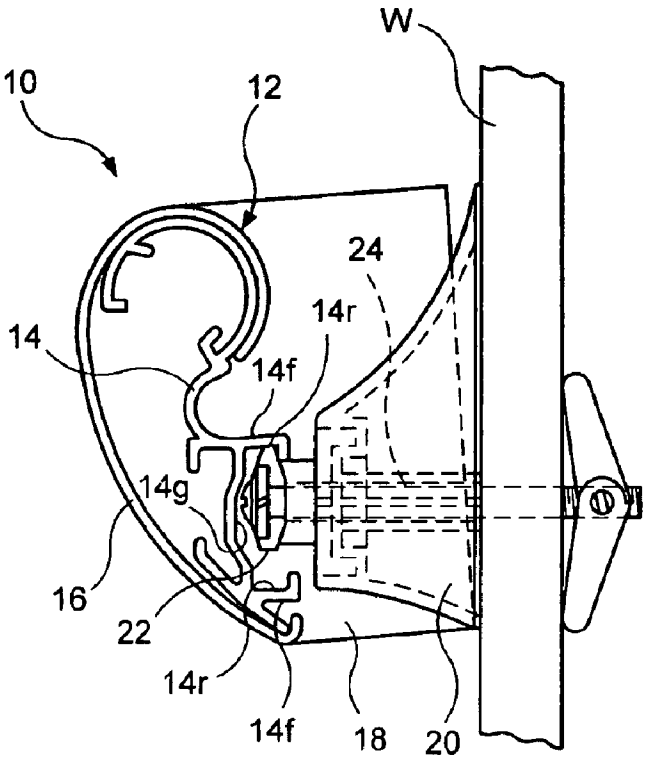
FIG. 1 PRIOR ART
Figure 3:
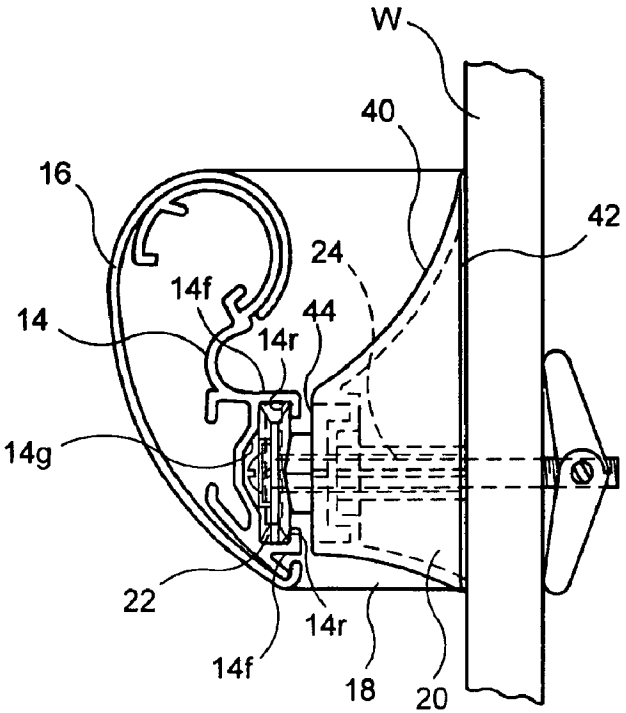
FIG. 3 PRIOR ART

The rail installation 10 shown in FIGS. 1 to 3 serves as a handrail when installed on a structure, which in most cases is a wall W. The rail (here a handrail) 12 is formed by an extended aluminum retainer 14 and a cover 16 of an impact-resistant, substantially rigid polmeric material, such as polyvinyl chloride blended with a small amount of an acrylic polymer. End pieces 18 attached to the longitudinal ends of the handrail 12 keep things from becoming caught on the otherwise exposed ends of the handrail. The handrail is mounted on the wall W by two or more supports located at a suitable longitudinal spacing. Each support includes a bracket 20, a lock member 22, and a fastener 24, such as a bolt and a toggle nut. FIG. 1 shows the handrail 12 loosely hanging on the lock member and ready for firm attachment to the support by rotating the lock member, as described below; FIG. 2 shows only the bracket 20 and the lock member 22 and also shows a tool T, an open end wrench in the embodiment, by which the lock member 22 is rotated from the unlocked position shown in FIG. 2 to the locked position; and FIG. 3 shows the lock member in the locked position and the rail firmly attached to the support.

Figure 4:
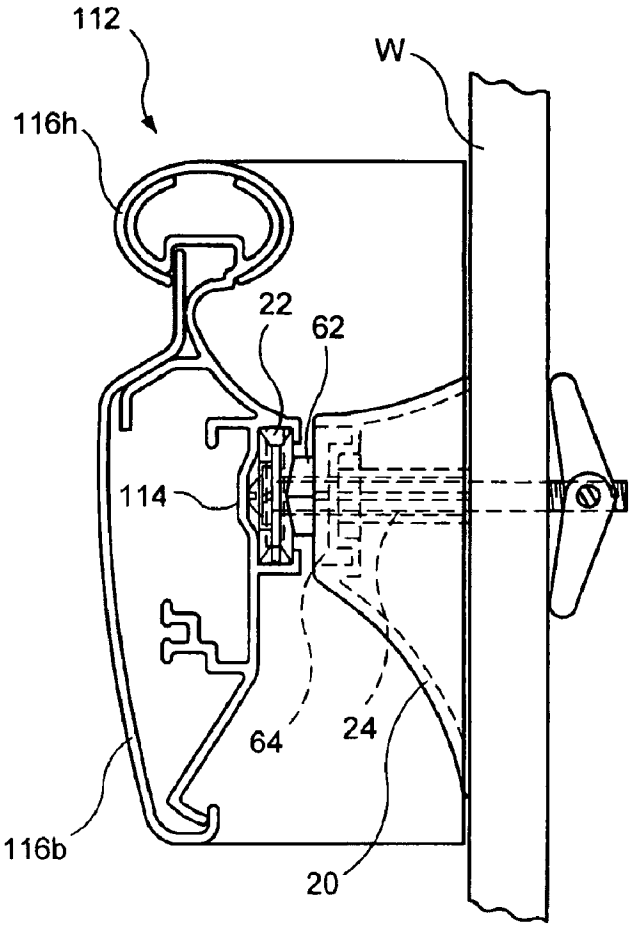
FIG. 4 PRIOR ART

Handrails of the type shown in FIGS. 1 and 3 are well known, per se, and are available commercially from several sources in a variety of configurations. FIG. 4 shows, for example, a handrail 112 in which the retainer 114 receives a handgrip cover 116*h* and a bumper cover 116*b*. The supports for the handrail of FIG. 4 are the same as those of FIG. 1 to 3, except that the brackets 20 are installed in an inverted position, relative to the handrail of FIGS. 1 to 3.

In the illustrated embodiment, the bracket 20 is molded from a rigid, strong polymeric material, such as PVC. As shown in FIG. 3, it includes an outer shell 40 having a relatively large supported end 42 that engages the wall or other structure over a relatively large area for load distribution and a relatively small supporting end 44 to which the rail is attached.

The lock member 22 has a locking cam portion 60, a shank 62 and a mounting base portion 64 and is molded from a rigid, strong polymeric material, such as nylon. The lock member can also be made of other materials, such as metal. The mounting base portion 64 of the lock member is configured to be rotatably received on the supporting end 44 of the bracket 20.

The locking cam portion 60 of the lock member 22 has a size and shape such that it can enter a generally C-shaped undercut groove in the rail when it is in an unlocked rotational position relative to the undercut groove and such that it frictionally engages walls of the undercut groove in a locked rotational position relative to the undercut groove and thereby retains the rail against displacement relative to the structure.

In the embodiment of FIGS. 1–3, the retainer 14 has L-shaped flanges 14*f* that define an undercut groove 14*g* and provide walls forming recesses 14*r* that face each other. The ends of the flanges 14*f* leave an opening into the groove 14*g* through which the locking cam portion 60 of the lock member 22 can pass when the lock member is in the unlocked position (see FIG. 1). In the locked position of the lock member, the surfaces of locking portions of the cam portion 60 frictionally engage the walls forming the recesses 14*r* of the undercut groove and firmly attach the rail 12 to the support. The dimension of the locking cam portion between the side edges ("side" relative to the locked position) is greater than the width of the shank portion 62 but less than the height of the opening into the undercut groove 14*g* of the retainer 14 so that the locking cam portion 60 can be accepted into the undercut groove when the rail is installed and when accepted allows the rail to hang loosely from the locking cam portion (see FIG. 1).

For a more complete description of the rail and support structure of the '458 patent, reference is made to the specification and drawings thereof incorporated herein.

Figure 7:
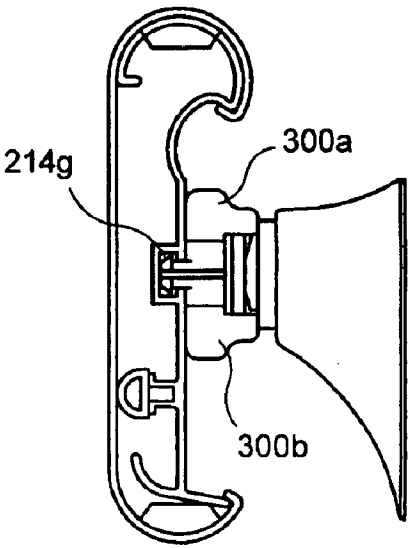
FIG. 7 is a right side elevational view similar to FIG. 6, but showing the lock member and the adapter in the locked positions.
Figure 6:
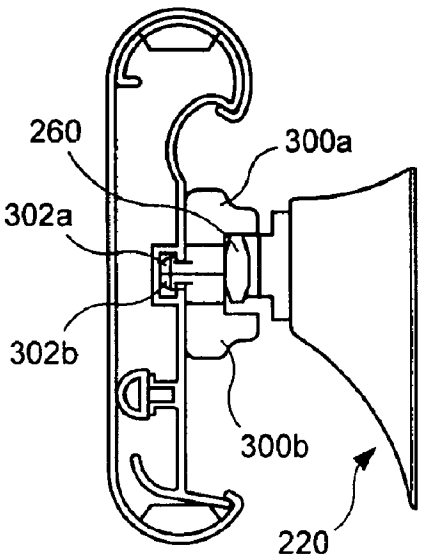
FIG. 6 is right side elevational view similar to FIG. 5, but showing the lock member engaged with the adapter and the adapter engaged with an undercut groove on the rail, with the locking member and the adapter shown in the unlocked positions.
Figure 5:
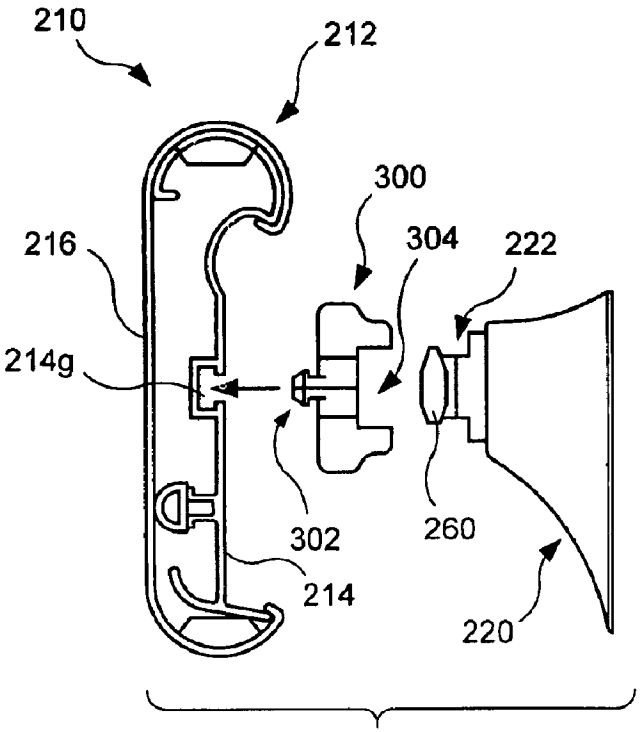
FIG. 5 is a schematic expanded right side elevational view of a handrail, a bracket member, a lock member, and an adapter in accordance with the invention, with the lock member and the adapter shown in the unlocked positions.

FIGS. 5–7 illustrate the application, in accordance with the present invention, of the support structure disclosed in the '458 patent to a rail installation 210 in which the rail is not directly compatible with the locking cam structure of the support. Such an incompatible rail might, for example, be a component of a pre-existing product line that lacks an appropriately sized and/or shaped undercut groove for coaction with the locking cam portion 60 of the locking member 22 of FIGS. 1–4.

In FIGS. 5–7, parts corresponding to like parts in FIGS. 1–3 are identified by like reference numbers, increased by 200. For brevity, only the differences between the embodiment of FIGS. 5–7 and the embodiment of FIGS. 1–3 are described, it being understood that the foregoing description and the disclosure of the '458 patent are otherwise applicable.

The rail installation 210 includes an elongated handrail 212 formed by an extruded aluminum retainer 214 and a cover 216 of impact restraint material. As shown, the rail 212 is of the handrail type which includes an existing axially extending undercut groove 214*g* of generally C-shaped cross section on the back side of the retainer 214 intended to receive a bolt head or nut for attachment of the retainer to a wall support. Such a groove 214*g* is known in the art as a "nut slot." It will be understood, however, that the undercut groove or slot 214*g* may be intended for other purposes and take other sizes and shapes. Also, the groove 214*g* need not be continuous along the full length of the retainer 214, but need extend only over those portions of the retainer 214 opposite the locations of the supports.

The support bracket 220 and the lock member 222 shown in FIGS. 5–7 are identical to the corresponding components 20 and 22, respectively, of FIGS. 1–4. Thus, each lock member 222 includes a locking cam portion 260 which is rotatable relative to the bracket 220, in the manner illustrated in FIG. 2, between an unlocked rotational position (FIGS. 5 and 6) and a locked rotational position (FIG. 7).

As may be seen in FIGS. 5 and 6, the locking cam portion 260 when in the unlocked rotational position is dimensionally incompatible with the groove 214*g*, i.e., the cam portion 260 is too large to be received within the groove 214*g*. In order to utilize the groove 214*g* as a mechanical attachment point for the lock member 222, an adapter 300 is provided in accordance with the present invention.

As described in detail hereinafter, the adapter 300 preferably comprises two identical components 300*a* and 300*b* that are assembled in a reversed, back-to-back configuration to form the complete adapter. So assembled, the adapter 300 has, on the side thereof facing the retainer 214, an extended portion 302 and, on the side thereof facing the locking member 222, an undercut recess 304. The adapter components 300*a* and 300*b* are movable apart in a direction transversely of the groove 214*g* between the unlocked position shown in FIGS. 5 and 6 and the locked position shown in FIG. 7. Such movement is caused by rotation of the locking cam portion 260 of the locking member 222.

During installation, the extended portion 302 of the adapter 300 is first inserted into the undercut groove 214*g* on the retainer 214. This may be done by sliding the extended portion 302 along the groove 214*g* from the end of the retainer 214. Alternatively, the extended portion 302 could be designed to snap into the groove 214*g* in the nature of a detent. The undercut recess 304 at the rear of the adapter is then slipped over the locking cam portion 260 of the locking member 222 (FIG. 6). Thereafter, the locking member 222 is rotated to the locked rotational position by use of the tool T (FIG. 2). As shown in FIG. 7, this causes the sides of the locking cam portion 260 to engage the walls of the undercut recess 304 in the adapter 300 in the same way that the locking cam portion 60 engages the walls of the undercut groove 14*g* in FIGS. 3 and 4, thereby securing the adapter 300 to the bracket 220 and simultaneously urging the adapter components 300*a* and 300*b* apart in the transverse direction to bring the respective extended portions 302*a* and 302*b* thereof into securing engagement with the walls of the groove 214*g*. The rail 212 is thereby securely mounted on the wall structure W, with the advantages and benefits attendant thereto as described in the '458 patent.

FIGS. 8–12 show the preferred embodiment of the adapter 300 in more detail. As mentioned, the components 300*a* and 300*b* of the adapter are preferably identical and assembled in a reversed, back-to-back configuration to form the adapter. FIGS. 8–12, therefore, show only a single component 300*a*, but it will be understood that the figures and the description which follows apply to the component 300*b* as well.

Each component is preferably made of high strength, injection-molded plastic, but could be produced from other suitable formable materials, e.g., die cast metal, if desired. The component 302*a* thus comprises a unitary formed part which can be readily and economically produced. As only two components are required to complete the adapter 300 and as both are identical, only a single type part need be manufactured and inventoried. Obvious economics in respect of manufacturing and installation costs and procedures are realized.

Figure 9:
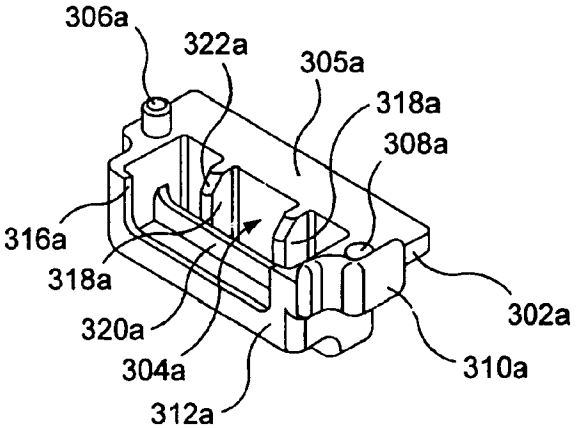
FIGS. 8 and 9 are front and rear perspective views, respectively, of one of the identical halves of an adapter as shown in FIGS. 5–7.
Figure 8:
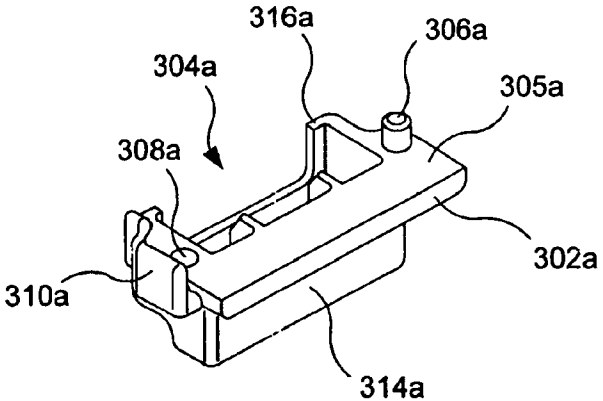
Figure 12:
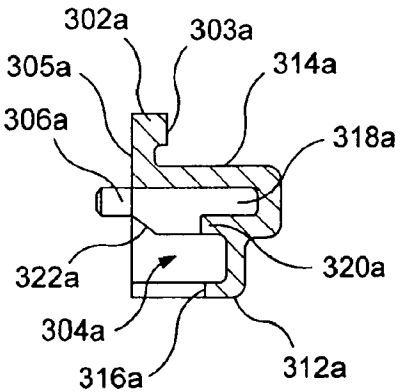
FIG. 12 is a cross-sectional view taken along the line 12—12 in FIG. 10.
Figure 11:
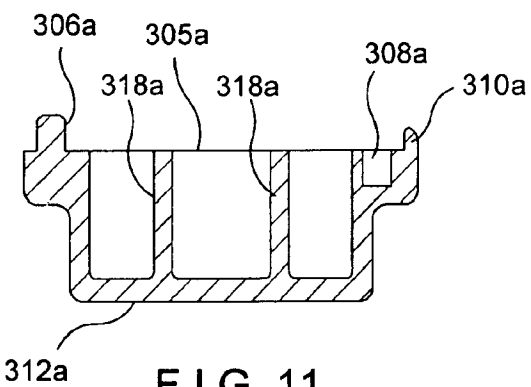
FIG. 11 is a cross-sectional view taken along the line 11—11 in FIG. 10.
Figure 10:
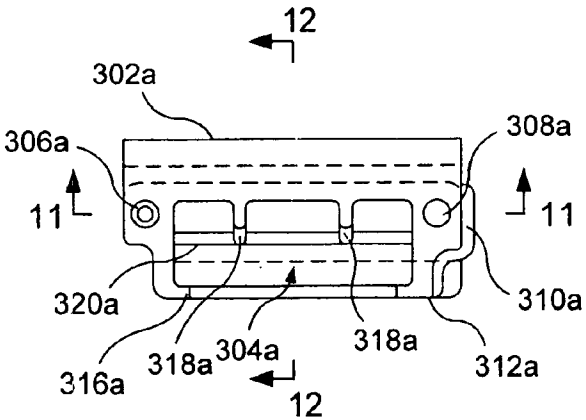
FIG. 10 is a top view of the identical half of the adapter shown in FIG. 9.

FIG. 8 depicts the component 300*a* from the side facing the rail retainer 214, while FIG. 9 depicts it from the side facing the locking member 222. On the side thereof facing the other adapter component, the component 300*a* has a generally planar surface 305*a* which, in the unlocked position of the adapter, abuts the like surface of the other component. The surface 305*a* extends forwardly from the body of the component 300*a* and underlies the extended portion 302*a* of the component. In the embodiment shown, the extended portion 302*a* is in the form of a cantilevered arm having an upright flange 303*a* at its free end (FIG. 12). If the flange 303*a* is to be snapped into the groove 214*g*, the forward surface of the flange is preferably beveled as indicated schematically in FIGS. 5–7.

Extending from the surface 305*a* perpendicularly outward at one end of the component is a molded-in alignment pin 306*a* and perpendicularly inward at the other end of the component is a molded-in mating recess 308*a*. When the adapter components are assembled in reversed, back-to-back relation as shown in FIGS. 5–7, the pin 306 of one component is mated within the recess 308 of the other component to retain the two halves together once they are inserted in the groove 214*g* of the retainer and to guide the component halves in their transverse movement between the unlocked (FIGS. 5 and 6) and locked (FIG. 7) positions.

An upright flange 310*a* is molded at the end of the component 302*a* adjacent to the recess 308*a*, and preferably extends from the rear wall 312*a* to the front wall 314*a* of the component. The flange 310*a* overlaps the pin-end of the other component in the assembled adapter to cover the gap between the two components 300*a* and 300*b* that exists when the adapter is in the locked position within the groove 214*g* (FIG. 7).

At the back side thereof, the component 302*a* is formed with an undercut recess 304*a* of a size and shape which, when taken together with the like recess of the other adapter component, receives and coacts with the locking cam portion 260 of the locking member 222 as described above. The opening of the recess 304*a* through the rear wall 312*a* is surrounded by a flange 316*a* which overlies the opening and engages the surface of the locking cam portion 260 when it is in the locked rotational position. (For ease of illustration, the rear flange 316*a* is not shown in the schematic views of FIGS. 5–7) Internally of the recess 304*a*, the adapter component 300*a* is formed with two transversely extending ribs 318*a* and a lengthwise extending rib 320*a*. These ribs serve to transfer the torsional load from the locking member 222 back into the retainer 214 and also to position the locking cam portion 222 at the proper location within the adapter 300. To that end, the end of each transverse rib 318*a* adjacent the planar surface 305*a* of the adapter component 302*a* is beveled, as indicated at 322*a*, to facilitate entry of the locking cam portion 260 into the space between the rear flange 316*a* and the rear surfaces of the ribs 318*a* and 320*a*.

Although the invention has been described herein by reference to specific embodiments thereof, it will be understood by those skilled in the art that such embodiments are susceptible of variation and modification without departing from the inventive concepts disclosed. All such variations and modifications, therefore, are intended to be included within the spirit and scope of the appended claims.

What is claimed is:

1. An adapter attached to an elongated rail having an undercut groove facing a structure on which the rail is to be mounted to a support therefor including a rotatable locking cam portion that is rotatable between unlocked and locked rotational positions, said adapter comprising:

an extended portion adapted to be received in the undercut groove on the rail, the extended portion being movable between an unlocked position in which it can enter the undercut groove and a locked position in which it engages walls of the undercut groove to lock the rail to the adapter; and an undercut recess facing the support, the undercut recess having a size and shape such that, when the locking cam portion is in the unlocked rotational position, it can enter the undercut recess and such that, when the locking cam portion is in the locked rotational position, it causes the extended portion of the adapter to move from the unlocked position to the locked position and thereby retain the rail against displacement relative to the support.

2. The adapter according to claim 1, wherein at least the extended portion of the adapter comprises two extended members which extend into the undercut groove and, upon rotation of the locking cam portion to the locked rotational position, are moved away from each other to engage the walls of the undercut groove.

3. The adapter according to claim 1, wherein the adapter comprises a first adapter component and a second adapter component, the two adapter components being substantially identical and each including an extended member comprising one-half of the extended portion of the adapter.

4. The adapter according to claim 3, wherein the two adapter components are assembled together in reversed, back-to-back relation to form the adapter.

5. The adapter according to claim 3, wherein the extended member of each adapter component comprises a cantilevered arm having a flange at the free end thereof for engagement with a wall of the undercut groove.

6. The adapter according to claim 3, wherein each adapter component comprises a pin and a mating recess for cooperative sliding engagement with the pin and the mating recess of the other adapter component.

7. The adapter according to claim 4 or 6, wherein each adapter component is a unitary formed part.

8. The adapter according to claim 6, wherein rotation of the locking cam portion to the locked rotational position causes the two adapter components to be moved away from each other so as to cause the extended members of the adapter components to engage the walls of the undercut groove, the two adapter components being guided in such movement by the cooperative engagement of the pins and mating recesses of the adapter components.

9. The adapter according to claim 1, wherein the adapter is a unitary molded plastic part.

10. The adapter according to claim 1, wherein the adapter is a unitary die cast metal part.

11. A rail and supports therefor, comprising:

an elongated rail having an axis;

an undercut groove extending axially along the rail;

an adapter having an extended portion received in the undercut groove on the rail, the extended portion being movable between an unlocked position in which it can enter the undercut groove and a locked position in which it engages walls of the undercut groove to lock the rail to the adapter, and an undercut recess facing the structure on which the rail is mounted; and a plurality of supports attached to the rail in spaced-apart relation, each support including:

(1) a bracket member having a supported surface adapted to engage the structure on which the rail is mounted and having a supporting surface spaced apart from the supported surface;

(2) a lock member received on the supporting surface of the bracket member, the lock member having a locking cam portion received in the undercut recess of the adapter, the locking cam portion having a size and shape such that, when in an unlocked rotational position relative to the undercut recess, it can enter the undercut recess and such that, when in a locked rotational position relative to the undercut recess, it causes the extended portion of the adapter to move from the unlocked position to the locked position and thereby retain the rail against displacement relative to the support; and (3) a fastener joining the lock member to the bracket member against displacement of the lock member relative to the bracket member and for rotation of the lock member relative to the bracket member.

12. The rail and supports therefor according to claim 11, wherein the size and shape of the undercut groove are incompatible for receipt and/or locking engagement with the locking cam portion.

13. The rail and supports therefor according to claim 11, wherein at least the extended portion of the adapter comprises two extended members which extend into the undercut groove and, upon rotation of the locking cam portion to the locked rotational position, are moved away from each other to engage the walls of the undercut groove.

14. The rail and supports therefor according to claim 11, wherein the adapter comprises a first adapter component and a second adapter component, the two adapter components being substantially identical and each including an extended member comprising one-half of the extended portion of the adapter.

15. The rail and supports therefor according to claim 14, wherein the two adapter components are assembled together in reversed, back-to-back to form the adapter.

16. The rail and supports therefor according to claim 14, wherein the extended member of each adapter component comprises a cantilevered arm having a flange at the free end thereof for engagement with a wall of the undercut groove.

17. The rail and supports therefor according to claim 16, wherein each adapter component comprises a pin and a mating recess for cooperative sliding engagement with the pin and the mating recess of the other adapter component.

18. The rail and supports therefor according to claim 15 or 17, wherein each adapter component is a unitary formed part.

19. The rail and supports therefor according to claim 17, wherein rotation of the locking cam portion to the locked rotational position causes the two adapter components to be moved away from each other so as to cause the extended members of the adapter components to engage the walls of the undercut groove, the two adapter components being guided in such movement by the cooperative engagement of the pins and mating recesses of the adapter components.

20. The rail and supports therefor according to claim 11, wherein each adapter is a unitary, molded plastic part.

21. The rail and supports therefor according to claim 11, wherein each adapter is a unitary die cast metal part.

22. The rail and supports therefor according to claim 11, wherein the undercut groove on the rail comprises a nut slot.

23. The rail and supports therefor according to claim 11, wherein the undercut groove extends partially along the length of the rail.

* * * * *